United States Patent [19]

Hood

[11] Patent Number: 4,466,252

[45] Date of Patent: Aug. 21, 1984

[54] CRYOPUMP

[75] Inventor: Charles B. Hood, Columbus, Ohio

[73] Assignee: CVI Incorporated, Columbus, Ohio

[21] Appl. No.: 426,518

[22] Filed: Sep. 29, 1982

[51] Int. Cl.[3] ..... B01D 8/00

[52] U.S. Cl. ..... 62/55.5; 55/269; 62/268; 417/901

[58] Field of Search ..... 62/55.5, 100, 268; 417/901; 55/269

[56] References Cited

U.S. PATENT DOCUMENTS 3,390,536 7/1968 Kreisman ..... 62/55.5
3,490,247 1/1970 Wing ..... 62/55.5
4,325,220 4/1982 McFarlin ..... 62/55.5

OTHER PUBLICATIONS

Basics of Cryopumping, p. 4.

*Primary Examiner*—Ronald C. Capossela
*Attorney, Agent, or Firm*—Seidel, Gonda & Goldhammer

[57] ABSTRACT

The inner cryopanel of a cryopump includes a substrate having a plurality of holes such that the open areas represent 30% to 70% of the surface area of the substrate. A layer of cryosorbing material is secured to one surface of the substrate. An imperforate panel is juxtaposed to said one surface of said substrate.

9 Claims, 6 Drawing Figures

FIG. 1
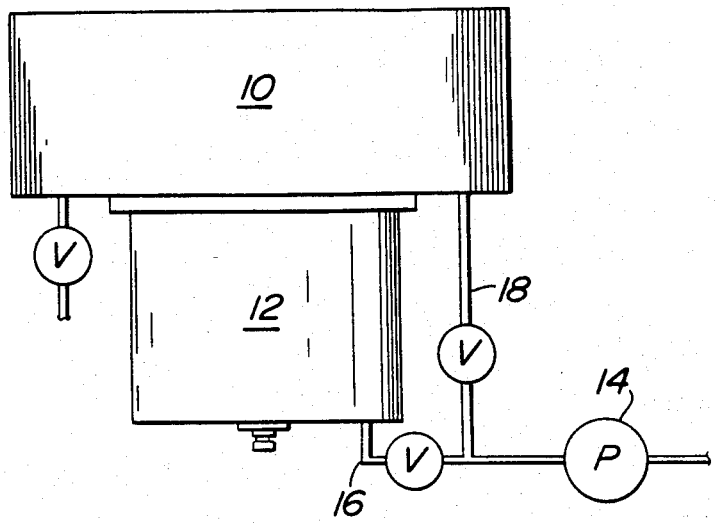
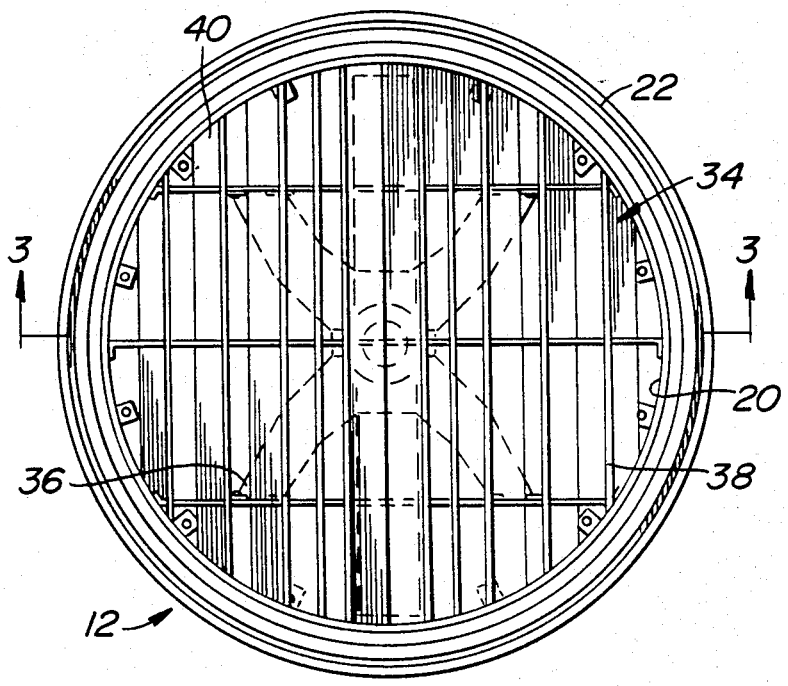
FIG. 2

CRYOPUMP

BACKGROUND OF THE INVENTION

A typical cryopump includes a cryogenic refrigerator that produces refrigeration at two temperature stages. The first stage of the cryogenic refrigerator typically operates in the range of 50 to 75K and is used to cool the outer cryopanel and the louvers across the inlet of the pump. The second stage of the cryogenic refrigerator is the coldest stage and typically operates in the range of 10 to 20K. The second stage is used to cool the inner cryopanel.

In a typical cryopump, water vapor freezes out on the louvers. Nitrogen, oxygen and argon freeze out on the outer surface of an inverted U-shape substrate. Hydrogen, helium, and neon are adsorbed on a layer of charcoal attached to the inner surface of the substrate. Charcoal or some other cryosorbing material is provided to absorb the hydrogen, helium and neon since their equilibrium vapor pressures are too high at 20K to be cryocondensed on the bare substrate. Activated charcoal is the preferred cryosorbing material because it has a large surface area and gases desorb from charcoal quite readily at room temperature during regeneration. The cryosorbing material is provided on the inner surface of the U-shaped substrate so as to be protected from the air gases which otherwise would coat the surface and fill the pores thereby rendering them inaffective for pumping.

The present invention is directed to a solution of the problem of how to increase the efficiency of cryosorbing molecules of hydrogen, helium and neon.

SUMMARY OF THE INVENTION

The present invention is directed to a cryopump having an inner cryopanel adapted to freeze out gases. The inner cryopanel includes a substrate having a plurality of holes such that the open areas represent 30 to 70% of the surface area of the substrate. A layer of cryosorbing materials secured to one surface of said substrate. An imperfored panel is juxtaposed to said one surface of said substrate.

Various objects and advantages of the present invention will be set forth hereinafter.

For the purpose of illustrating the invention, there is shown in the drawings a form which is presently preferred; it being understood, however, that this invention is not limited to the precise arrangements and instrumentalities shown.

FIG. 1 is a diagramatic illustration of a cryopump in association with a vacuum chamber.

FIG. 2 is a top plan view of the cryopump.

Figure 3:
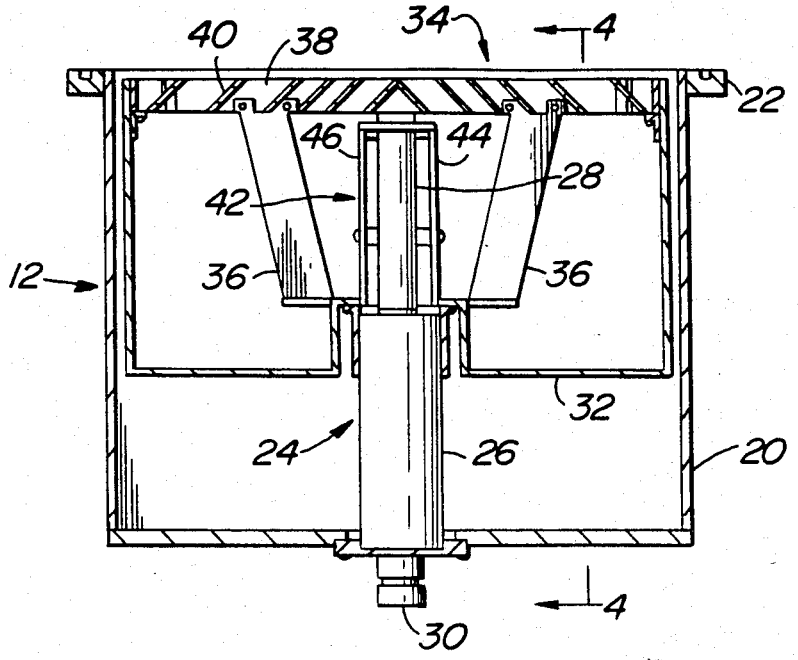
FIG. 3 is a sectional view taken along the line 3—3 in FIG. 2.

Referring to the drawing in detail, wherein like numerals indicate like elements, there is shown in FIG. 1 a vacuum chamber 10 coupled by way of a valve not shown to the inlet of a cryopump 12. A roughing pump 14 is connected by way of valve conduit 16 to the cryopump 12 and by way of the valve conduit 18 to the vacuum chamber 10.

Figure 4:
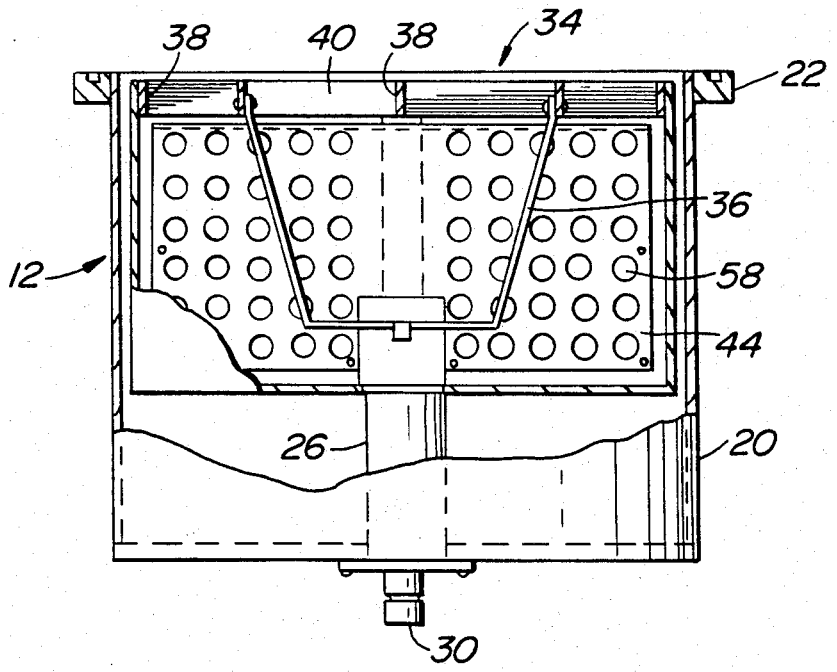
FIG. 4 is a sectional view taken along the line 4—4 in FIG. 3.

Referring to FIGS. 2–4, the cryopump 12 includes an outer housing 20 provided with a mounting flange 22 at its upper end. Flange 22 is adapted to be connected to the vacuum chamber 10 in a conventional manner. Within the housing 20, there is provided a cryogenic refrigerator 24 having a first stage 26 and a second stage 28. The refrigerator 24 includes a port 30 adapted to be coupled to a compressor. The cyrogenic refrigerator is preferably a two stage Gifford-McMahon refrigerator. A variety of such refrigerators are known and no effort will be made herein to describe all of the components thereof.

The cryopump 12 is provided with an outer cryopanel 32 within the housing 20. The outer cryopanel 32 is connected to a chevron ring assembly 34 having depending conductor vanes 36. The vanes 36 and the outer cryopanel 32 are coupled to a heat station on the upper end of first stage 26.

The ring assembly 34 includes an annular support 38 having diametrical and chordal supports for louvers 40 made from a good conducting material such as copper. All of the louvers 40 are planar except for the center louver which is an inverted V-shaped louver.

Figure 5:
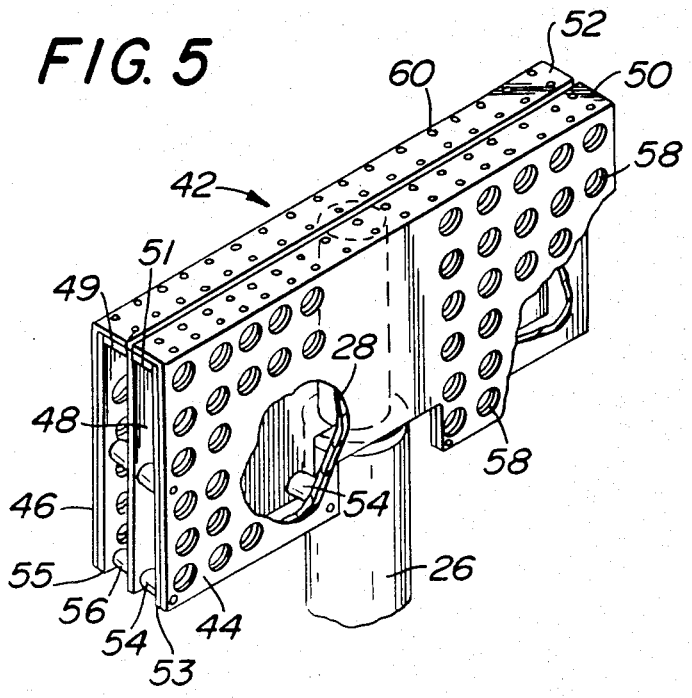
FIG. 5 is a perspective view of the inner cryopanel mounted on the cryogenic refrigerator.

An inner cryopanel 42 is mounted on the heat station of the second stage 28. As shown more clearly in FIG. 5, the inner cryopanel 42 includes a first substrate 44 parallel to second substrate 46. The substrates 44 and 46 are on opposite sides of an imperforate panel 48. Substrate 44 has a flange 50 and substrate 46 has a flange 52. The flanges 50, 52 are fixedly connected in any convenient manner to the upper end of the panel 48. Flanges 50, 52 are preferably attached to a thermal conducting bar 49 or 51 by rivets 60. The conducting bars are fixed to the heat station at the upper end of the second stage 28 and are in thermal contract with panel 48.

Panel 48 is preferably made in two pieces which extend radially outwardly from diametrically opposite locations on the second stage 28. The substrates 44, 46 and panel 48 are maintained in spaced parallel relationship by way of spacers 54, 56. Each of the substrates 44, 46 is provided with a plurality of holes 58 preferably occupying 30–70% of the surface area of the substrates. The surface of substrate 44 juxtaposed to the panel 48 is provided with a layer of cryosorbing material 53 such as activated charcoal. A similar layer of cryosorbing material 55 is applied to the surface of substrate 46 juxtaposed to the panel 48.

Figure 6:
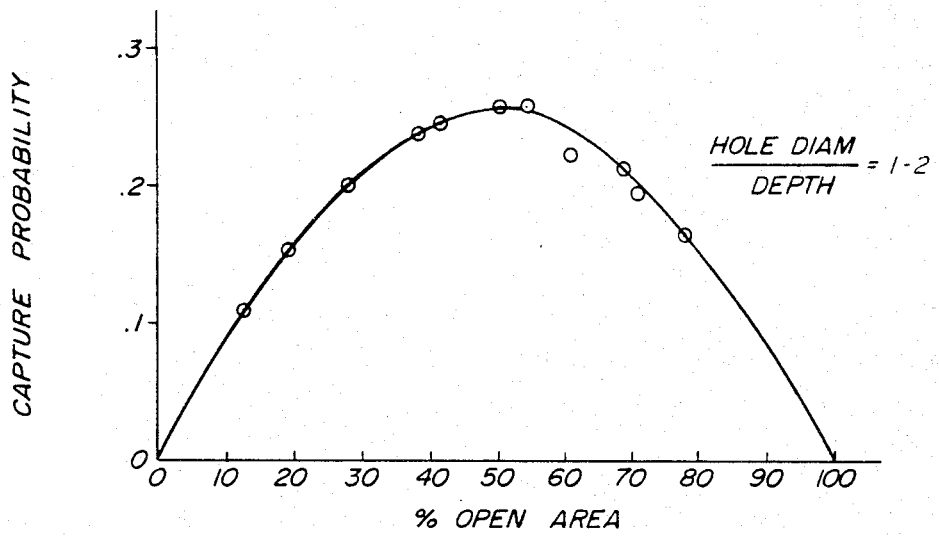
FIG. 6 is a graph of capture probability versus percent open area wherein the ratio of hole diameter to depth equals 1.2.

In FIG. 6, there is illustrated a graph of capture probability of hydrogen, helium and neon molecules versus percent open area. The percent open area refers to the percent of the area of the holes 58 versus the surface area of their associated substrate. It will be seen that when the ratio of hole diameter to depth is 1.2, the most efficient portion of the curve requires the percent open area to be between 30% and 70%. The "depth" refers to the distance between the juxtaposed surfaces of panel 48 and the substrates 44, 46.

The substrates 44, 46 and the imperforate panel 48 need not be flat planar members as illustrated. Thus, the substrates 44, 46 may be one inverted Ushaped member juxtaposed to an imperforate U-shape panel of smaller configuration and disposed therewith. Also, the substrates may be curved, semi-spherical, and have other shapes.

DESCRIPTION OF OPERATION

The environment or the vacuum chamber 10 may assume a wide variety of processes well known to those skilled in the art of cryogenics. let it be assumed that chamber 10 has been evacuated to the desired pressure. When chamber 10 communicates with the inlet to cryopump 12, water vapor freezes out when it contacts the louvers 40. Nitrogen, oxygen and argon not captured by surfaces of substrates 44 and 46 will flow through the holes 58 and freeze out on the panel 48. Hydrogen, helium and neon flowing through holes 58 will bounce off the panel 48 and will be adsorbed by the cryosorbing layers 53, 55 on the substrates 44, 46 respectively. The capacity of the cryopump for air gases is very large.

The area of the holes 58 is a compromise between pumping speed and pumping capacity. The depth between the surfaces of panel 48 and the surfaces of the substrates 44, 46 is important since it must not be too small in relation to the size of the holes 58. The ratio of hole diameter of holes 58 to the depth is preferably about 1.2. However, as pointed out this is a compromise and may be varied depending upon design criteria.

The present invention may be embodied in other specific forms without departing from the spirit or essential attributes thereof and, accordingly, reference should be made to the appended claims, rather than to the foregoing specification, as indicating the scope of the invention.

I claim:

1. In a cryopump comprising an inner cryopanel adapted to freeze out gases in an evacuated environment, said cryopanel including a substrate having a layer of cryosorbing material secured to one surface thereof, said material being capable of desorbtion at room temperature, said substrate having a plurality of aligned holes such that the open area represents 30% to 70% of the surface area of the substrate, and said cryopanel including an imperforate panel juxtaposed to and spaced from said cryosorbing material.

2. In a cryopump in accordance with claim 1 including a pair of said substrates on opposite sides of said imperforate panel.

3. In a cryopump in accordance with claim 2 wherein said substrates are connected to the second stage of a cryogenic refrigerator, said imperforate panel extending from diametrically opposite locations on said second stage.

4. In a cryopump in accordance with claim 2 wherein each substrate is connected at its upper end to the upper end of said panel by a good thermal conducting strip.

5. A cryopump having a louvered inlet and an outer cryopanel for freezing out water vapor adjacent thereto, an inner cryopanel for freezing out various gases, said inner cryopanel including an imperforate panel for freezing out nitrogen and oxygen gases, said inner cryopanel including a perforate substrate adjacent said imperforate panel, said substrate including a perforated layer of cryosorbing material juxtaposed to said panel for adsorbing hydrogen and helium gases which pass through the perforations and bounce off said imperforate panel.

6. A cryopump in accordance with claim 5 including a second substrate parallel to the said first substrate, said substrates being on opposite sides of said panel and parallel to said panel.

7. A cryopump in according with claim 6 wherein the open areas of said substrates represent 30% to 70% of the surface area of the substrates.

8. A cryopump having a louvered inlet and an outer cryopanel connected to the upper end of a first stage of a refrigerator for freezing out water vapor, an inner cryopanel including an imperforate panel for freezing out nitrogen and oxygen, said inner cryopanel including a pair of perforated substrates adjacent said panel, said substrates being on opposite sides of said panel and parallel to said panel, said substrates including a perforated layer of cryosorbing material secured to a surface of the substrate juxtaposed to said panel for adsorbing hydrogen and helium gases, and wherein the open areas of said substrates represent 30% to 70% of the surface area of the substrates.

9. A cryopump in accordance with claim 8 wherein said substrates are connected to the second stage of a cryogenic refrigerator with each substrate being connected at its upper end to the upper end of said imperforate panel by a good thermal conducting strip, said inner cryopanel being open at its bottom and at its ends.

* * * * *